US005473891A

United States Patent [19]

Baxter et al.

[11] Patent Number: 5,473,891

[45] Date of Patent: Dec. 12, 1995

[54] THREE-PIECE STAMP FORMED CONNECTOR FOR ACHIEVING EQUAL LENGTH EXHAUST PIPES

[75] Inventors: Colette Baxter; John Roberts, both of Toledo, Ohio

[73] Assignee: AP Parts Manufacturing Company, Toledo, Ohio

[21] Appl. No.: 258,090

[22] Filed: Jun. 10, 1994

[51] Int. Cl.[6] ..... F01N 7/00

[52] U.S. Cl. ..... 60/313; 60/323; 181/238

[58] Field of Search ..... 60/312, 313, 323; 181/238, 228, 276

[56] References Cited

U.S. PATENT DOCUMENTS

| | | | |
|---|---|---|---|
| 1,271,779 | 7/1918 | Schroeder et al. | 285/424 |
| 3,412,825 | 11/1968 | Hall | 181/61 |
| 3,605,940 | 9/1971 | Christensen | 60/313 |
| 4,082,325 | 4/1978 | Laundy | 285/155 |
| 4,621,494 | 11/1986 | Fujita | 60/313 |
| 4,700,806 | 10/1987 | Harwood | 181/282 |
| 4,736,817 | 4/1988 | Harwood | 181/282 |
| 4,759,423 | 7/1988 | Harwood et al. | 181/282 |
| 4,760,894 | 8/1988 | Harwood et al. | 181/282 |
| 4,765,437 | 8/1988 | Harwood et al. | 181/282 |
| 4,821,840 | 4/1989 | Harwood et al. | 181/282 |
| 4,836,330 | 6/1989 | Harwood et al. | 181/282 |
| 4,847,965 | 7/1989 | Harwood et al. | 29/157 R |
| 4,860,853 | 8/1989 | Moring, III | 181/282 |
| 4,894,987 | 1/1990 | Harwood et al. | 181/282 |
| 4,901,815 | 2/1990 | Harwood et al. | 181/282 |
| 4,901,816 | 2/1990 | Garey | 181/296 |
| 4,905,791 | 3/1990 | Garey | 181/282 |
| 4,909,348 | 3/1990 | Harwood et al. | 181/282 |
| 4,928,372 | 5/1990 | Harwood et al. | 29/890.08 |
| 4,949,807 | 8/1990 | Hirata et al. | 181/240 |
| 5,004,069 | 4/1991 | Van Blaircum et al. | 181/282 |
| 5,042,125 | 8/1991 | Harwood et al. | 29/33 K |
| 5,134,852 | 8/1992 | Weeks | 60/323 |
| 5,152,138 | 10/1992 | Tanabe et al. | 60/323 |
| 5,164,551 | 11/1992 | Harwood et al. | 181/238 |
| 5,173,577 | 12/1992 | Clegg et al. | 181/282 |
| 5,252,788 | 10/1993 | Emrick et al. | 181/282 |
| 5,327,722 | 7/1994 | Clegg et al. | 60/323 |

*Primary Examiner*—Ira S. Lazarus
*Assistant Examiner*—L. Heyman
*Attorney, Agent, or Firm*—Anthony J. Casella; Gerald E. Hespos

[57] ABSTRACT

A connector is provided for joining two upstream exhaust pipes with a downstream exhaust pipe and for substantially offsetting any difference in length that may exist in the upstream exhaust pipes. The connector includes first and second external shells that are secured on opposite respective sides of an internal divider plate. The external shells and internal plates cooperate to define unequal travel lengths within the connector to offset the unequal travel lengths of the upstream exhaust pipes leading to the connector. The two separate exhaust flows with travel lengths equalized by the connector converge with one another into a chamber defined by the connector, and exit from the connector through an outlet. Expansion of the converging exhaust gas streams into the chamber contributes to acoustical tuning of the exhaust system. The equal lengths of the respective exhaust gas streams also facilitates acoustical tuning performed by a downstream muffler.

17 Claims, 3 Drawing Sheets

THREE-PIECE STAMP FORMED CONNECTOR FOR ACHIEVING EQUAL LENGTH EXHAUST PIPES

BACKGROUND OF THE INVENTION

1. Field of the Invention

The subject invention is directed to a stamp formed connector for joining at least two conventional upstream exhaust pipes to at least one conventional downstream exhaust pipe.

2. Description of the Prior Art

The typical prior art exhaust system includes at least one manifold for collecting exhaust gas produced by the cylinders of an internal combustion engine. A pipe delivers the exhaust gas from the manifold to a catalytic converter where certain objectionable pollutants are converted into a less objectionable form. Another pipe extends from the catalytic converter to a muffler which attenuates noise associated with the flowing exhaust gas. At least one tail pipe then extends from the muffler to a location on the vehicle where the exhaust gases can be safely emitted.

The exhaust system becomes very hot, and must be routed to ensure sufficient clearance from parts of the vehicle that could be damaged by heat. This exhaust system routing also must pass through locations that are sufficiently large to accommodate the catalytic converter and the muffler. These controls on the location of exhaust system generally result in a very circuitous alignment.

Exhaust system routing is particularly complex for V-engines, such as V-8's or V-6's. The cylinders of a V-engine are disposed in two angularly aligned planes and emit exhaust gases from opposite respective sides of the engine. As a result, two separate exhaust pipes must extend from the spaced apart manifolds of the V-engine. Some vehicles with V-engines include entirely separate exhaust systems, with separate catalytic converters, separate mufflers and separate tail pipes. However, these systems are costly, and can further complicate the efforts to locate the respective catalytic converters and mufflers. As a result, most vehicles with V-engines have the respective exhaust pipes converge and join at a location upstream from the catalytic converter. Thus, the exhaust gas streams from each of the two manifolds on the V-engine typically communicate with a single catalytic converter and a single muffler.

Noise produced by an internal combustion engine is actually a series of repeating noises corresponding respectively to the sequential controlled explosions taking place in the cylinders of the engine. Engineers examine the loudness and frequency of noise resulting from these explosions, and design an appropriate array of tubes and chambers in a muffler for attenuating the observed noise. The task of designing a muffler is made more difficult if the noise from the respective explosions does not define a uniform and repetitive pattern approaching the muffler. A non-uniform pattern may cause sound waves from one explosion to partly overlap sound waves from a subsequent explosion. The additive effect of these overlapping noise patterns can complicate the acoustical tuning of the exhaust system.

Most properly timed engines will produce uniform firing of the cylinders, and hence have the potential to direct a uniform series of noise patterns to the muffler for attenuation. However, V-engines with a single muffler often have different exhaust gas travel lengths between the respective manifolds and the muffler. If possible, engineers will try to route the exhaust pipes for a V-engine to achieve substantially equal lengths between the respective manifolds and the point where the exhaust pipes converge. Although this objective is desirable, it is difficult to achieve. In particular, the typical engine compartment is extremely crowded, and engineers have few options for re-routing pipes to achieve the equal lengths. Additionally, the few options that may permit substantially equal lengths of pipes extending from the manifolds may bring the upstream and downstream exhaust pipes together at angles that are difficult or impossible to miter and weld properly. The complex mitering and welding to join the upstream and downstream exhaust pipes into a Y-shape is a time consuming procedure that is not well suited to a high degree of automation.

In the recent past, stamp formed connectors have been used to join two upstream exhaust pipes to a single downstream exhaust pipe. For example, U.S. Pat. No. 5,134,852 shows a pair of opposed stamped plates that are formed to define a first inlet, an outlet linearly aligned to the first inlet and a second inlet angularly aligned to both the first inlet and the outlet. The stamp formed connector shown in U.S. Pat. No. 5,134,852 avoids the need to miter and weld the pipes. However, the required linear alignment of the outlet pipe to one of the inlets would limit the options available for achieving equal lengths between the manifolds and the location at which the upstream exhaust pipes converge.

A very desirable stamp formed connector for achieving equal length exhaust pipes is shown in U.S. patent application Ser. No. 103,974 which is assigned to the assignee of the subject invention. The connector shown in U.S. patent application Ser. No. 103,974 consists of two plates that are stamp formed with channels disposed for defining exhaust passages between the plates. The passages include a pair of inlet passages and an outlet passage which converge at a selected location between the plates of the connector. The passages are curved to achieve a selected routing of the exhaust system components and to substantially equalize the travel length for exhaust gases traveling toward a muffler. By achieving these equal travel lengths, the noise pulses from the engine will arrive at the muffler uniformly and predictably. Thus, acoustical tuning of the muffler downstream from the connector is facilitated.

Although the connector shown in U.S. patent application Ser. No. 103,974 is extremely effective, there are still situations where it is difficult to compensate for differential pipe lengths between the manifolds and the point of convergence within the connector. In particular, the range of options for forming curved passages within the connector are limited by the space available for the connector and the amount of metal deformation that can take place within that space. These options may not be sufficient to offset the differences in exhaust gas travel lengths upstream of the connector.

Connectors also can complicate acoustical tuning and design. In particular it is difficult to predict the exact acoustical effect of the converging exhaust flows, or to determine the precise location for the convergence to take place. A significant amount of trial and error is required to achieve the best system design. However trial and error can be time consuming with both the prior art miter-and-weld connectors and the prior art two-piece stamp formed connector.

In view of the above, it is an object of the subject invention to provide a connector with an enhanced ability to achieve equal lengths for exhaust pipes.

Another object of the subject invention is to provide a stamp formed connector that avoids excessive deformation of the sheet material from which the connector is formed.

An additional object of the subject invention is to provide a stamp formed connector that enables inlet and outlet pipes to be placed in very close proximity to one another.

Still another object of the subject invention is to provide a stamp formed connector that enables optimum alignment of pipes leading to and from the connector.

SUMMARY OF THE INVENTION

The subject invention is directed to a stamp formed connector for joining at least two upstream exhaust pipes to at least one downstream exhaust pipe. The connector is particularly effective for achieving equal flow lengths in an exhaust system.

The connector of the subject invention includes a formed internal divider plate disposed between and securely connected to first and second formed external shells. Peripheral regions of the internal divider plate and the external shells are formed to define at least first and second inlets to the connector and at least one outlet from the connector. The first and second inlets are connectable to first and second upstream exhaust pipes, and are formed to permit exhaust flow into first and second flow paths defined within the connector. At least one of the flow paths is defined between the second external shell and the internal divider plate. A convergence chamber is defined between the first external shell and the internal divider plate and communicates with the first and second flow paths. The internal divider plate may be formed with at least one convergence aperture to permit convergence of exhaust gas that is flowing from the first and second flow paths to the convergence chamber. The outlet from the connector is connectable to a downstream exhaust pipe and receives exhaust gas from the convergence chamber between.

The location of the convergence aperture and the relative formed configurations of the internal divider plate and the external shells may be selected to achieve unequal flow lengths between the convergence aperture and the respective first and second inlets. The inequality in these respective flow lengths may be selected to offset the inequality in the flow lengths in the first and second upstream exhaust pipes. These unequal flow lengths within the connector can be achieved by the dimensions and configurations of channels and chambers stamp formed into the external shells and the internal divider plate. Additionally, the location and size of the convergence aperture are factors in determining the differences in the first and second inlet flow lengths within the connector. Engineers can readily fine tune the acoustical performance of the exhaust system by testing connectors with convergence apertures having different sizes, shapes and locations. This fine tuning can be carried out without changing the bends of the respective pipes and without altering the overall stamped formation of the connector.

In some instances, acoustical tuning may be enhanced by providing a controlled amount of exhaust gas cross-flow and expansion prior to the point of convergence between the respective first and second flows. This cross-flow upstream of the point of convergence can be provided by forming perforations, apertures or louvers through the internal divider plate at locations between the point of convergence and one of the inlets or the outlets.

DETAILED DESCRIPTION OF THE PREFERRED EMBODIMENT

Figure 1:
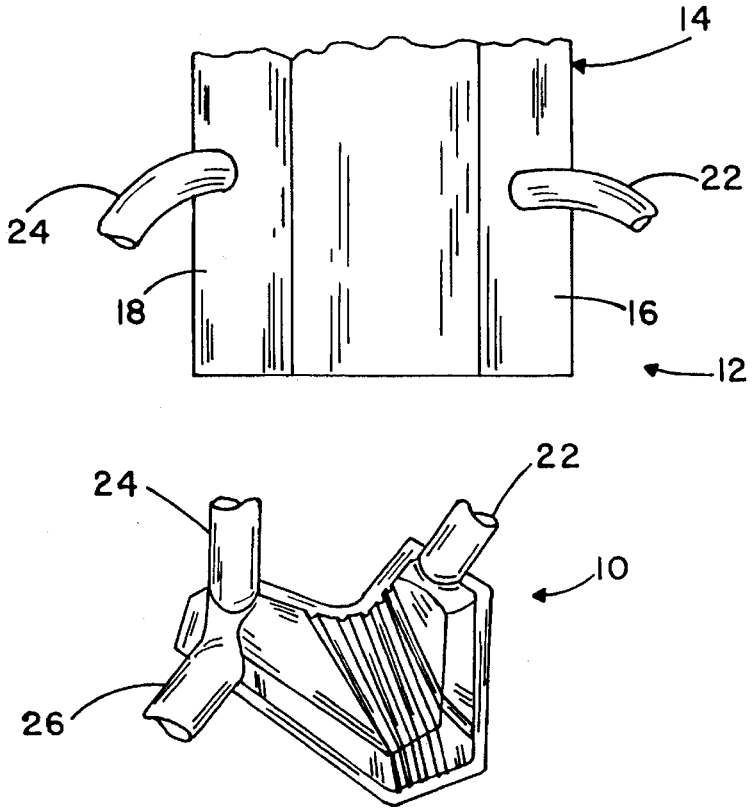
FIG. 1 is a schematic view of the connector of the subject invention disposed in proximity to a vehicular engine.

A connector in accordance with the subject invention is identified generally by the numeral 10 in FIGS. 1–6. As shown schematically in FIG. 1, the connector 10 is part of an exhaust system 12 which attenuates noise associated with exhaust gas produced by combustion in an engine 14. The engine 14 is a V-engine with a first plurality of cylinders disposed in one plane and a second plurality of cylinders disposed in a second plane. Exhaust gas produced by the first plurality of cylinders is collected in a first manifold 16, and exhaust gases produced in the second plurality of cylinders is collected in a second manifold 18. First and second upstream exhaust pipes 22 and 24 extend respectively from the first and second manifolds 16 and 18 to the connector 10. The two separate flows of exhaust gas flowing through the first and second upstream exhaust pipes 22 and 24 converge in the connector 10 and are directed through a single downstream exhaust pipe 26 toward a catalytic converter and muffler (not shown).

As illustrated schematically in FIG. 1, the connector 10 is non-symmetrically disposed with respect to the V-engine 14. This non-symmetrical disposition is common, and typically is dictated by available space in or near the engine compartment or on the underside of the vehicle. For example, a transmission and drive shaft may prevent the upstream exhaust pipes from converging at a symmetrical position directly behind the engine. In other situations, the V-engine may be transversely aligned, and the exhaust pipe that extends from the forwardly disposed manifold typically will travel a greater distance than the exhaust pipe extending from the rearwardly disposed manifold.

Exhaust gas noise is defined by a plurality of discrete pulses corresponding respectively to the firings of the cylinders. Attenuation of the exhaust gas noise can be carried out most efficiently if the respective pulses arrive at the muffler sequentially. However, unequal travel lengths for exhaust gas flowing from two separate banks of cylinders can result in some noise pulses from one bank of cylinders overlapping and adding to noise pulses generated by the other bank of cylinders. These combined noise patterns may not be adequately attenuated by the muffler. As shown in FIG. 1, the non-symmetrical alignment of the exhaust system 12 results in the first upstream exhaust pipe 22 being longer than the second upstream exhaust pipe 24. As a result, the exhaust system 12 has the potential for generating overlapping and additive noise pulses. This potential design problem is avoided by the connector 10 as explained and illustrated further herein.

With reference to FIGS. 2–8, the connector 10 includes first and second external shells 32 and 34 and an internal divider plate 36, all of which are stamp formed from metallic sheet material to define an array of channels and chambers that accommodate the flowing exhaust gas. The first external shell 32 is formed to include a peripheral flange 38 and a convergence chamber 40 extending away from the peripheral flange 38, as shown most clearly in FIG. 2. The peripheral flange 38 and the convergence chamber 40 are characterized by first and second semi-cylindrical inlet nipples 42 and 44 and an outlet nipple 46 which will mate respectively to the first and second upstream exhaust pipes 22 and 24 and the downstream exhaust pipe 26. The convergence chamber 40 defined by the first external shell 32 also is characterized by an array of reinforcing grooves 48 which extend entirely across the external shell 32 for preventing vibration related noise.

Figure 4:
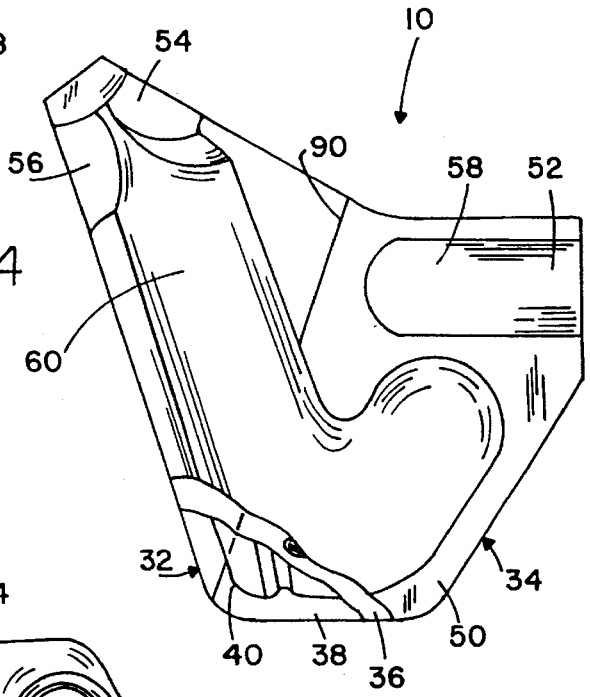
FIG. 4 is a top plan view of the connector with the first external shell and the internal divider plate shown partly in section.
Figure 5:
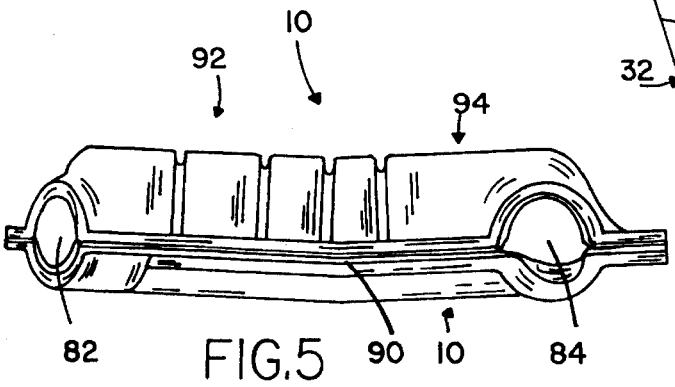
FIG. 5 is a front elevational view of the connector.

The second external shell 34, as shown in FIGS. 4 and 5, has a periphery 50 dimensioned and configured to register with the peripheral flange 38 of the first external shell 32. Peripheral regions 50 of the second external shell 34 are further characterized by first and second generally semi-cylindrical inlet nipples 52 and 54 and a generally semi-cylindrical outlet nipple 56 which are disposed and dimensioned to generally register with the inlet nipples 42 and 44 and the outlet nipple 46 of the first external shell 32. A first inlet channel 58 extends a short distance inwardly from the first inlet nipple 52. A much longer second inlet channel 60 communicates with the second inlet nipple 54. The second inlet channel 60 extends entirely along one side of the second external shell 34, undergoes a substantially 135° change in direction, and then continues toward the first inlet channel 58. However, the first and second inlet channel 58 and 60 formed in the second external shell 34 do not meet.

Figure 3:
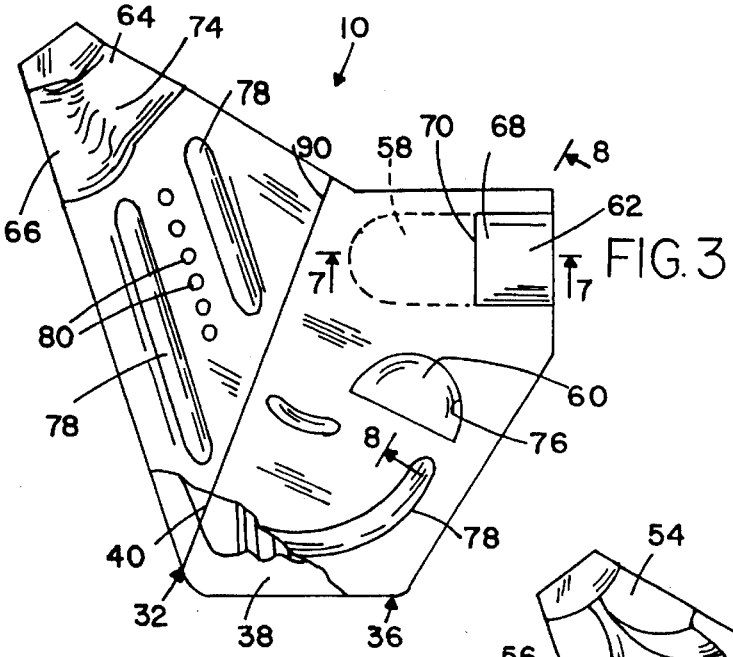
FIG. 3 is a top plan view of the connector with the first external shell shown partly in section.
Figure 7:
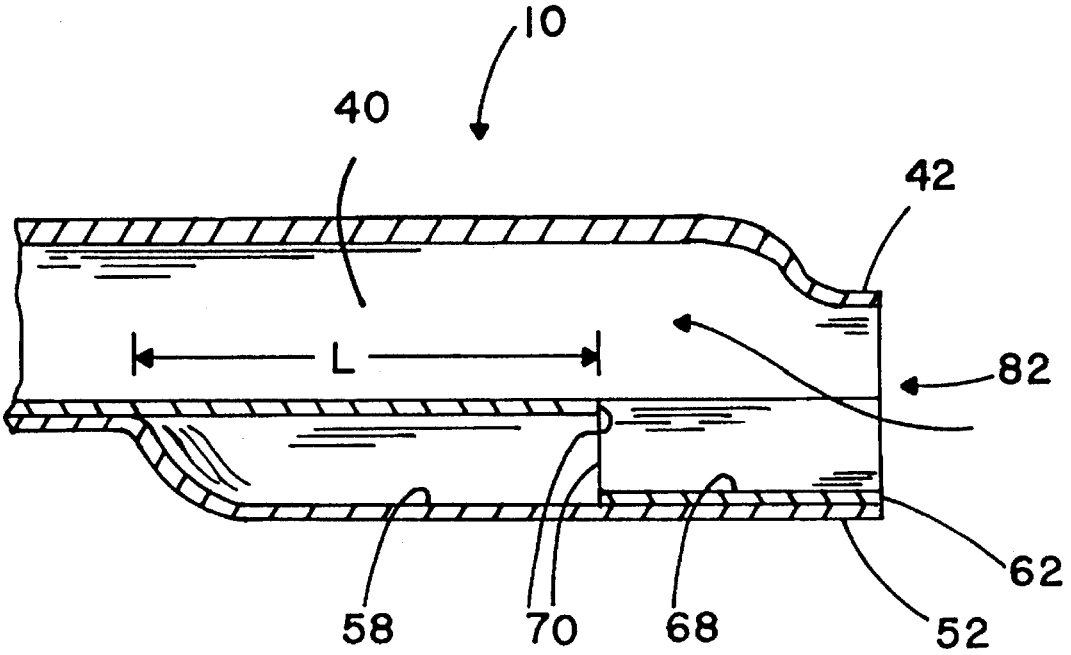
FIG. 7 is a cross-sectional view taken along line 7—7 in FIG. 3.

The internal divider plate 36, as shown in FIG. 3, has an outer periphery dimensioned and configured to register with the respective peripheries 38 and 50 of the first and second external shells 32 and 34. The internal divider plate 36 is characterized by a first generally semi-cylindrical inlet nipple 62, a second generally semi-cylindrical inlet nipple 64 and a generally semi-cylindrical outlet nipple 66. The first inlet nipple 62 of the internal divider plate 36 is formed to nest with the first inlet nipple 52 of the second external shell 34 and to project oppositely from the first inlet nipple 42 of the first external shell 32. An inlet channel 68 extends from the first inlet nipple 62 and is formed to nest with the first inlet channel 58 of the second external shell 34. As shown in FIGS. 3 and 7, the inlet channel 68 terminates at a cut 70 through the internal divider plate 36 at a location registered with the first inlet channel 58 of the second external shell 34. As will be explained further below, a tuning or Helmholtz tube is effectively defined between the cut 70 and the closed end of the first inlet channel 58 of the second external shell 34. The location of the cut 70 defines the length "L" of the tuning tube, and hence partly determines the frequency of noise that will be attenuated. In other embodiments, no cut 70 is provided, and the inlet channel 68 of the internal divider plate 36 will be formed to nest with substantially the entire first inlet channel 58 of the second external shell 34. In still other embodiments, the inlet channel 68 of the internal divider plate 36 may be formed to extend away from the second external shell 34 and may terminate at a cut out. With this latter embodiment, a first inlet tube is defined between the inlet channel 68 of the internal divider plate 36 and the first inlet channel 58 of the second external shell 34, and the length of this first inlet tube is defined by the location of the cut out in the internal divider plate 36.

The second inlet nipple 64 of the internal divider plate 36 is formed to nest with the second inlet nipple 44 of the first external shell 32 and to project in an opposite direction from the second inlet nipple 54 of the second external shell 34. Thus, in the illustrated embodiment, the first and second inlet nipples 62 and 64 of the internal divider plate 36 project in opposite directions from adjacent planar portions of the internal divider plate 36.

Figure 6:
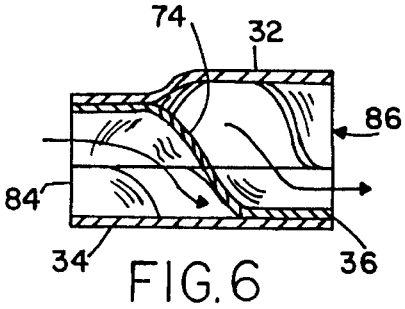
FIG. 6 is a cross-sectional view taken along line 6—6 in FIG. 2.

The outlet nipple 66 of the internal divider plates 36 is formed to nest with the outlet nipple 56 of the second external shell 34 and to project oppositely from the outlet nipple 46 of the first external shell 32. A dividing wall 74 extends between the second inlet nipple 64 of the internal divider plate 36 and the outlet nipple 66 thereof, as shown in FIG. 3 and 6.

The internal divider plate 36 is further characterized by a convergence cut-out 76 disposed to register with a selected location on the second inlet channel 60 of the second external shell.

The internal divider plate 36 also is characterized by reinforcing embossments 78, and may optionally be provided with apertures 80 at locations that will register with the second inlet channel 60 of the second external shell 34.

The connector 10 is assembled by securely attaching the first and second external shells 32 and 34 to opposite respective sides of the internal divider plate 36. The attachment preferably is achieved by laser welding around the periphery of the respective registered components. However, other welding techniques may be employed or the parts may be mechanically held in secure engagement by crimping, or the like. In their connected disposition, the first inlet nipple 62 and the outlet nipple 66 of the internal divider plate 36 will nest with the first inlet nipple 52 and the outlet nipple 56 of the second external shell 34, but will extend in opposite directions from the respective first inlet nipple 42 and the outlet nipple 46 of the second external shell 34 to define a first inlet 82 and an outlet 86 on the connector 10. The second inlet nipple 64 of the internal divider plate 36, however, will nest with the second inlet nipple 44 of the first external shell 32, and will be in opposed relationship to the second inlet nipple 54 of the second external shell 34 to define a second inlet 84.

Exhaust gas flowing from the first upstream exhaust pipe 22 and entering the connector 10 through the first inlet 82 will flow directly into the convergence chamber 40. A narrow range of noise frequency will be attenuated by the tuning tube defined between the first inlet channel 58 of the second external shell 34 and registered portions of the internal divider plate 36 adjacent cut 70, as shown in FIG. 7. As shown in FIG. 7, exhaust gas entering the first inlet 82 will flow only a short distance within the connector 10 before entering the convergence chamber 40 defined by the first external shell 32.

Figure 8:
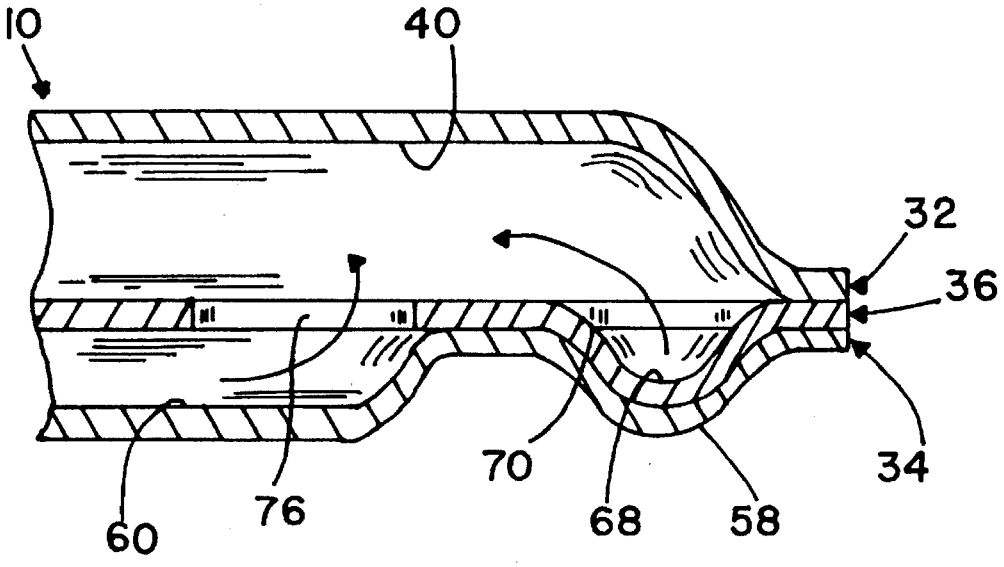
FIG. 8 is a cross-sectional view taken along line 8—8 in FIG. 3.

Exhaust gas flowing from the second upstream exhaust pipe 24 will enter the second inlet 84 of the connector 10. Although the second inlet 84 is close to the outlet 86, the dividing wall 74 of the internal divider plate 36 will prevent any cross-flow between the second inlet 84 and the outlet 86 at this location. Rather, exhaust gas entering the second inlet 84 will continue through the tube defined by the second inlet channel 60 of the second external shell 34 and opposed portions of the internal divider plate 36. This flow of exhaust gas will continue through the 135° change of direction in the second inlet channel 60 and will enter the convergence chamber 40 of the first external shell 32 through the convergence cut-out 76 in the internal divider plate 36 as shown in FIG. 8. Thus, the connector 10 defines a substantially greater travel length for gas entering the second inlet 84 than for gas entering the first inlet 82. This greater travel length preferably is selected to substantially offset the differences in the lengths of the first and second upstream exhaust pipes 22 and 24 respectively. The two streams of exhaust gas will converge within the convergence chamber 40 at a location in proximity to the first inlet 82 and the convergence cut-out 76, as shown in FIG. 8. The converging exhaust gases will then be permitted to expand in the convergency chamber 40 and will flow toward the outlet 86 of the connector 10. As shown most clearly in FIG. 6, the flow of exhaust gas through outlet 86 is separated from the flow of exhaust gas into inlet 84 only by the dividing wall 74.

In addition to the acoustical benefits achieved by equal length exhaust flow paths, the expansion of exhaust gas into the convergence chamber 40 and the provision of a tuning table also contribute to noise attenuation. The specific acoustical tuning effects can be altered by varying the volume of chamber 40 or the length "L" of the tuning tube consistent with the space availability on the vehicle.

Acoustical tuning can further be altered by varying the internal divider plate 36. For example, the convergence cut-out 76 can be changed in size or selectively moved to other locations registered with the second inlet channel 60 of the second external shell 34. This option can be useful for fine tuning the acoustical performance of the exhaust system 12 or for accommodating different models of related engine systems where the upstream exhaust pipe routing on one model may be slightly different from that on another model. Additionally, in some systems apertures 80 or functionally comparable louvers or slots may provide some acoustically beneficial cross-flow of exhaust gas without negating the objective of achieving substantially equal lengths of exhaust gas flow to the point of convergence.

Figure 2:
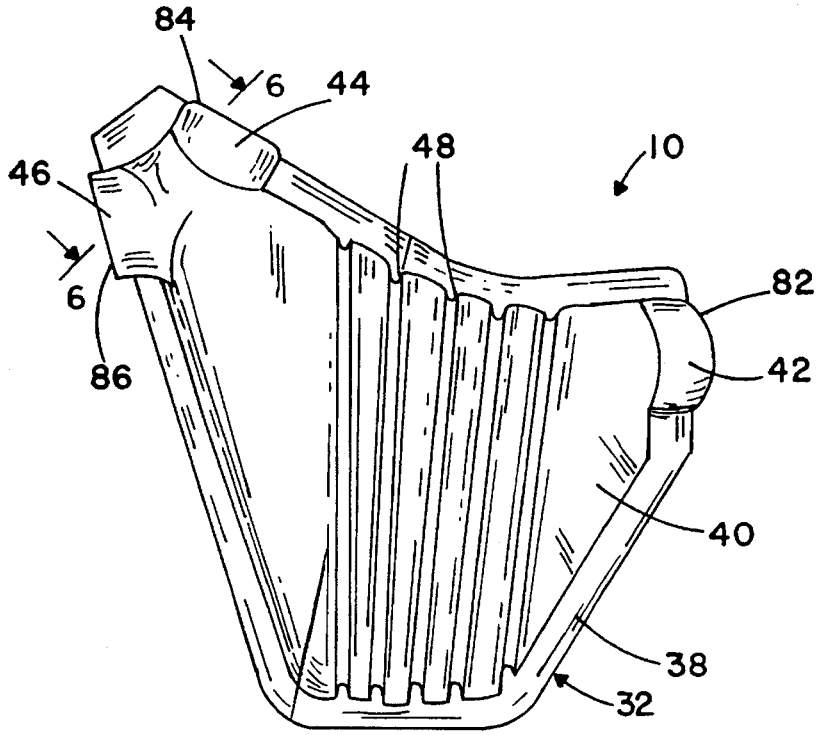
FIG. 2 is a top plan view of the connector.

As shown most clearly in FIG. 5, the attached peripheral regions of the first and second external shells 32 and 34 and the internal divider plate 36 lie in two planes. The planes intersect along a line 90 as shown in FIGS. 2–4. The first inlet 82 and the connector 10, such that the longitudinal axis of the first upstream exhaust pipe 22 lie within a first planar portion 92. The second inlet 84 and the outlet 86 lie in a second planar portion 94 of the connector 10. The longitudinal axes of the second upstream exhaust pipe 24 and the downstream exhaust pipe 26 are co-planar with the second planar portion 94. This non-planar configuration of the connector 10 enables the inlets 82 and 84 and the outlet 86 of the connector 10 to conform to the optimal alignment of the respective upstream and downstream exhaust pipes 22–26 and to conform to the available space on the underside of the vehicle. Entirely planar connectors, on the other hand, generally would require further bends in the exhaust pipes to accommodate the planar configuration of the connector.

While the invention has been described with respect to a preferred embodiment, it is apparent that various changes can be made without departing from the scope of the invention as defined by the appended claims.

We claim:

1. A connector for connecting first and second upstream exhaust pipes of unequal lengths to a downstream exhaust pipe, said connector comprising: an internal divider plate having opposed first and second surfaces; a first external shell secured to said first surface of said internal divider plate and formed to define a chamber between said first external shell and said internal divider plate; a second external shell secured to said second surface of said internal divider plate; at least one of said internal divider plate and said first external shell being formed to define an outlet from said chamber for connecting said chamber to said downstream exhaust pipe; said external shells and said internal divider plate being formed to define first and second inlets for connection respectively to said first and second upstream exhaust pipes; first and second gas flow means defined adjacent said internal divider plate for providing communication between said first and second inlets respectively and said chamber; said first and second gas flow means defining unequal lengths that substantially offset the unequal lengths of said first and second upstream exhaust pipes.

2. A connector as in claim 1, comprising at least one channel formed in said second external shell, said channel and portions of said internal divider plate opposed thereto defining at least one of said first and second gas flow means.

3. A connector as in claim 2, wherein said channel is non-linear.

4. A connector as in claim 2, comprising at least one cut-out through said internal divider plate at a location in register with said channel of said second external shell for enabling convergence of exhaust gas from said first and second gas flow means in said chamber at a location substantially adjacent said cut-out.

5. A connector as in claim 1, wherein said outlet and one said inlet are separated from one another by said internal divider plate.

6. A connector as in claim 1, wherein peripheral regions of said first external shell define a peripheral flange for connection to said first side of said internal divider plate, portions of said peripheral flange adjacent said first inlet defining a first plane, and portions of said peripheral flange adjacent said second inlet defining a second plane, said first and second planes being angularly aligned to one another and being substantially co-planar with longitudinal axes defined by the respective first and second upstream exhaust pipes.

7. A connector as in claim 1, wherein the first inlet is defined by nested first inlet nipples formed respectively in said second external shell and said internal divider plate, and by an oppositely directed first inlet nipple formed in said first external shell, said first gas flow means comprising a first inlet channel formed in said second external shell and extending from the first inlet nipple thereof, and an inlet channel formed in the internal divider plate and nested with at least a portion of the first inlet channel of said second external shell, the inlet channel of the internal divider plate being opened to said chamber defined by said first external shell.

8. A connector as in claim 7, wherein the inlet channel of the internal divider plate is shorter than the first inlet channel of the second external shell, said inlet channel of said internal divider plate terminating at a cut through the internal divider plate and providing communication to a closed-end tuning tube formed by portions of the first inlet channel of the second external shell extending beyond the inlet channel of the internal divider plate.

9. A connector as in claim 7, wherein said second inlet is formed by nested second inlet nipples formed in said first external shell and said internal divider plate, and by an oppositely directed second inlet nipple formed in said second external shell, the second gas flow means comprising a second inlet channel formed in said second internal plate and extending from said second inlet toward said first inlet channel, said second gas flow means terminating at a cut-out through said internal divider plate at a location near the inlet channel of said internal divider plate for providing convergence and expansion of gas flows from said first and second upstream exhaust pipes into said chamber.

10. A connector for connecting first and second upstream exhaust pipes to a downstream exhaust pipe, said connector comprising: an internal divider plate having opposed first and second surfaces, first and second stamp formed external shells secured respectively to said first and second surfaces of said internal divider plate, said first external shell and said internal divider plate being formed to define a convergence chamber therebetween, a first inlet tube formed in part by said internal divider plate for connecting said first upstream exhaust pipe to said convergence chamber and an outlet for connecting said convergence chamber to said downstream exhaust pipe, said second external shell and said internal divider plate being formed to define a second inlet tube therebetween, said second inlet tube terminating at a cut-out formed through said internal divider plate and providing communication with said convergence chamber, such that exhaust gas from said first and second upstream exhaust pipes converge in said convergence chamber and flow to said downstream exhaust pipe.

11. A connector as in claim 10, wherein said first and second inlet tubes of said connector are of unequal lengths.

12. A connector for connecting first and second upstream exhaust pipes to a downstream exhaust pipe, said connector comprising an internal divider plate having opposed first and second surfaces, first and second external shells secured respectively to said first and second surfaces of said internal divider plate, said first external shell being formed to define a chamber, portions of said first external shell and said internal divider plate being formed to define a first inlet for connection to said first upstream exhaust pipe and an outlet for connection to said downstream exhaust pipe, a second inlet for connecting said second upstream exhaust pipe with said chamber, said second inlet being formed by a portion of said second external shell and by portions of said internal divider plate that define the outlet from said connector.

13. An exhaust system assembly comprising: first and second upstream exhaust pipes and a downstream exhaust pipe, each said exhaust pipe having a longitudinal axis, said longitudinal axes being angularly aligned to one another and being disposed to lie in two angularly aligned planes; and a connector comprising a plurality of metallic sheets secured in face-to-face relationship and stamp formed to define first and second inlets connected respectively to said first and second upstream exhaust pipes and an outlet connected to said downstream exhaust pipe, said plates of said connector further being stamp formed to define gas flow means for accommodating flows of exhaust gas from said first and second upstream exhaust pipes to said downstream exhaust pipe, said face-to-face disposition of said plates defining at least first and second angularly aligned planes, the longitudinal axis of said first upstream exhaust pipe lying in the first plane of said connector, and the longitudinal axis of the second upstream exhaust pipe lying in the second plane, whereby the angular alignment of the planes of said connector is selected to conform with a selected alignment of the first and second upstream exhaust pipes.

14. An exhaust system assembly as in claim 13, wherein the longitudinal axis of the downstream exhaust pipe lies in the second plane defined by the connector.

15. An exhaust system assembly as in claim 13, wherein the gas flow means comprises a first gas flow passage connected to the first upstream exhaust pipe, a second gas flow passage connected to the second upstream exhaust pipe and a convergence between the first and second gas flow passages, the convergence communicating with the downstream exhaust pipe.

16. An exhaust system assembly as in claim 15, wherein the first upstream exhaust pipe is longer than the second upstream exhaust pipe and wherein the second gas flow passage is longer than the first gas flow passage by a distance substantially equal to the difference in length between the first and second upstream exhaust pipes.

17. An exhaust system assembly as in claim 15, wherein the plurality of plates comprises first and second external shells and an internal divider plate, at least one of the first and second gas flow passages being formed between the second external shell and the internal divider plate, and the convergence defining a chamber between the first external shell and the internal divider plate.

* * * * *